United States Patent [19]

Harter

[11] Patent Number: 4,478,310

[45] Date of Patent: Oct. 23, 1984

[54] UNIVERSAL HEAT SHIELD

[75] Inventor: Donald P. Harter, Ottawa Lake, Mich.

[73] Assignee: APX Group, Inc., Toledo, Ohio

[21] Appl. No.: 478,849

[22] Filed: Mar. 25, 1983

[51] Int. Cl.[3] ..... F01N 7/18

[52] U.S. Cl. ..... 181/241; 181/211; 181/243; 126/83

[58] Field of Search ..... 181/211, 282, 283, 243, 181/241; 126/83

[56] References Cited

U.S. PATENT DOCUMENTS 3,237,716 3/1966 Parsons ..... 181/243

*Primary Examiner*—Michael L. Gellner
*Assistant Examiner*—Brian W. Brown
*Attorney, Agent, or Firm*—Anthony J. Casella; Gerald E. Hespos

[57] ABSTRACT

A universal heat shield which may be varied in length and shape to fit a variety of mufflers, catalytic converters, and the like, is disclosed. A pair of metal sheets, each of which includes a pair of planar members intersecting at a crease line, a pair of slots and a pair of tabs, are fastened to each other with screws which extend through the slots. The shield is fastened to the muffler by strapping the tabs to opposite ends of the muffler body.

8 Claims, 6 Drawing Figures

UNIVERSAL HEAT SHIELD

BACKGROUND OF THE INVENTION

The present invention is directed to the field of engine exhaust systems, and more particularly to a heat shield adapted for specific use with a part of an exhaust system, such as a muffler, catalytic converter, or the like.

It has become a widely used practice in the automotive and heavy equipment industry to employ heat shields in proximity to various components of an exhaust system. Many times, especially in vehicles and heavy equipment employed for agricultural purposes, heat shields are employed on exhaust system components such as mufflers, since such components are many times in direct contact with combustible material. Additionally, heat shields have become popular on ordinary passenger vehicles due to the wide use of catalytic converters which tend to become very hot under certain circumstances.

Heretofore, such heat shields have been designed for specific applications, a specific heat shield being designed for a particular muffler or converter. This can be troublesome when it is necessary to replace a muffler or converter, since the heat shield is typically provided separately. Thus, a supplier of exhaust system parts must stock a very large variety of different shields to accommodate an associated variety of replacement mufflers and converters.

OBJECTS AND SUMMARY OF THE INVENTION

It is therefore an object of the present invention to overcome the difficulties associated with prior art heat shields.

It is a further object to provide a universal heat shield which can be adjusted to fit a very wide variety of mufflers, converters, and the like, thus reducing inventory requirements.

In accordance with the invention, a shield adapted to be attached to a part of an exhaust system, such as a muffler, catalytic converter, or the like, comprises at least first and second sheets of metal, each having at least two generally planar members intersecting along crease lines and disposed such that the crease lines are substantially parallel. At least one slot is disposed in each planar member generally parallel to the associated creases. Each sheet of metal is provided with at least one mounting support. Preferably, the mounting supports define tabs disposed at the ends of the respective planar members generally parallel thereto but separated therefrom in directions normal to the respective planar surfaces. The first sheet of metal is adapted to overlie the second sheet of metal such that the respective creases are aligned and adjacent, and such that at least one slot in each of the overlapping planar members is at least partly in register with a slot in the corresponding planar member of the adjacent sheet of metal. The sheets of metal preferably are fixed to each other by screws which extend through the partly registered slots in the overlapping sheets of metal. The sheets may be secured to the exhaust system by strapping the planar tabs to opposite ends of the exhaust system part. Preferably the straps are adjustable to enable mounting of the sheets on exhaust systems of various size.

The length of the shield may be adjusted by loosening or removing the screws, sliding the sheets of metal relative to each other, and tightening or repositioning the screws, thereby accommodating exhaust system parts of varying lengths. Further, the contour of the shield may be adjusted by bending the sheets of metal along the crease lines to change the angle between the members, and thereby accommodate exhaust system parts of varying contours.

BRIEF DESCRIPTION OF THE DRAWINGS

These and other objects and aspects of the invention will now be described with reference to the following drawing figures of which.

DETAILED DESCRIPTION OF THE PREFERRED EMBODIMENT

Figure 1:
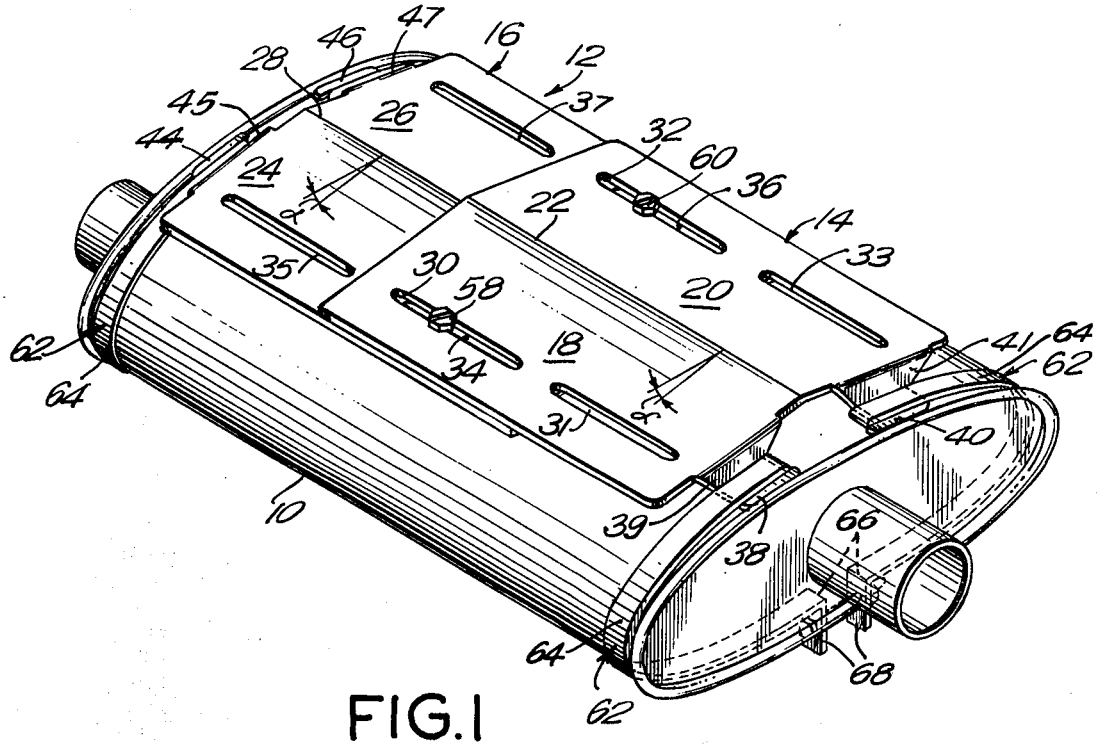
FIG. 1 is a perspective view of the shield in accordance with the present invention secured to a muffler.
Figure 2:
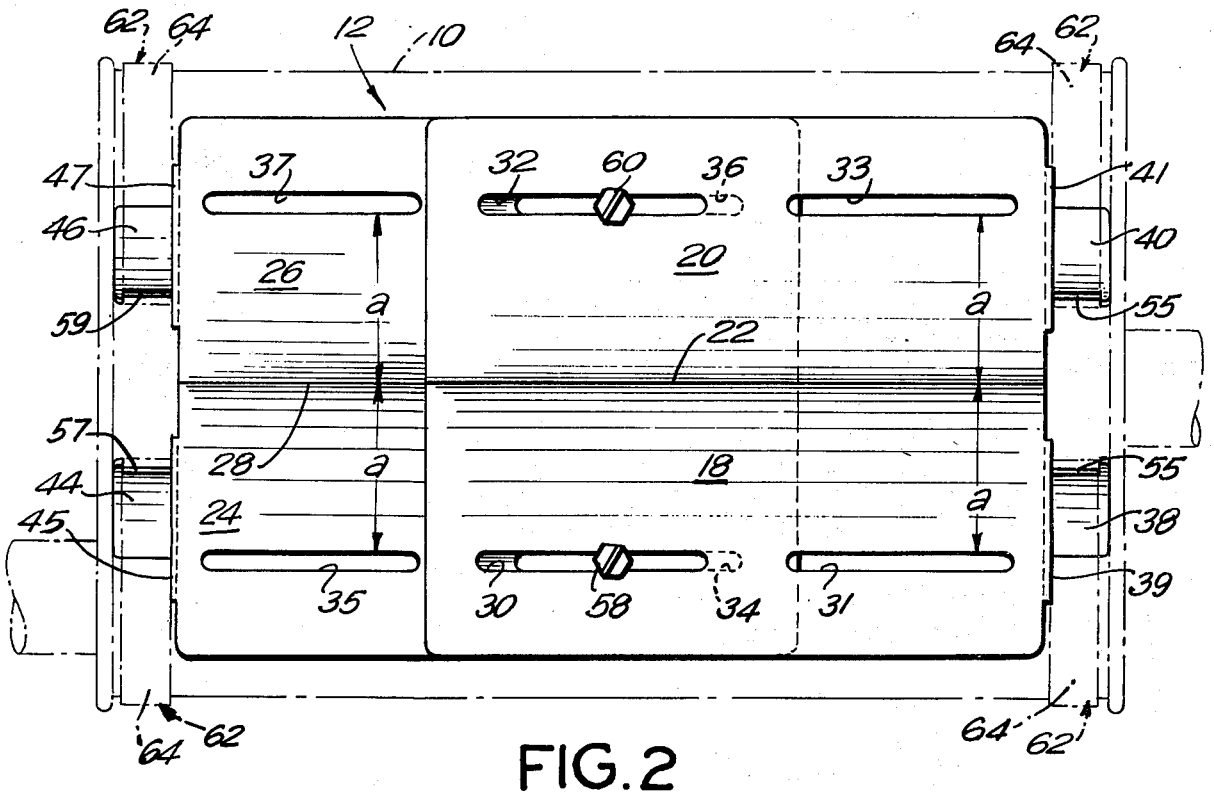
FIG. 2 is a top plan view of the heat shield in accordance with the present invention.
Figure 3:
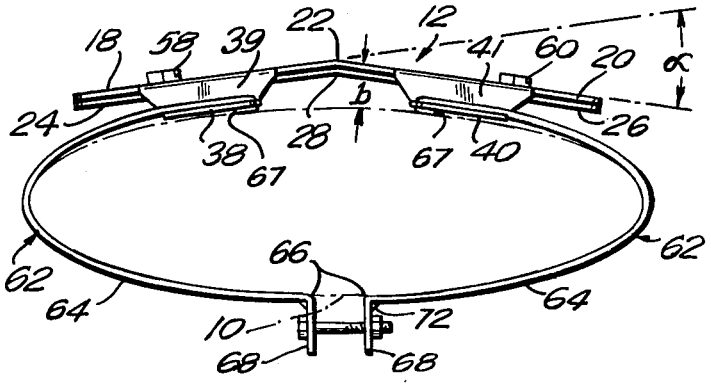
FIG. 3 is an end view of the heat shield shown in FIGS. 1 and 2.

As illustrated in FIGS. 1–3, the universal heat shield of the subject invention is indicated generally by the numeral 12 and is mounted on a muffler, indicated generally by the numeral 10. The universal heat shield 12 is comprised of a first sheet of metal 14 and a second sheet of metal 16. The first sheet of metal 14 has generally planar members 18 and 20, respectively, which intersect along crease line 22 at angle $\alpha$, as shown most clearly in FIG. 3. It has been found that if heat shield 12 is manufactured such that angle $\alpha$ equals approximately 15°, the subject heat shield 12 can be used with many automobile mufflers with little or no adjustment to angle $\alpha$. Similarly, the second sheet of metal 16 is provided with planar members 24 and 26 respectively which intersect to define crease line 28 at substantially the same angle "$\alpha$".

Each of the planar members 18, 20, 24 and 26 is approximately 9.75 inches long and approximately 4.5 inches wide. Additionally, each planar member is provided with a pair of slots, such that planar member 18 includes slots 30 and 31, planar member 20 includes slots 32 and 33, planar member 24 includes slots 34 and 35, and planar member 26 includes slots 36 and 37. Each slot is disposed in its respective planar member generally parallel to the associated crease 22 and 28. Additionally, each slot is spaced distance "a" from the respective crease 22 or 28 to enable longitudinal adjustments, as explained below. Preferably, distance "a" equals 3.00 inches.

Planar tabs 38, 40, 44 and 46 are disposed at the ends of the respective planar members 18, 20, 24 and 26. The planar tabs 38, 40, 44 and 46 are generally parallel to and spaced from their associated planar members. More particularly, each of the planar tabs 38, 40, 44 and 46 is attached to its respective planar member by means of the respective extensions 39, 41, 45 and 47. The extensions 39, 41, 45 and 47 are substantially perpendicular to their respective planar members and extend therefrom a distance "b" which preferably equals approximately 0.50 inches. Each tab 38, 40, 44 and 46 is provided with a notch 53, 55, 57 and 59 respectively on the side thereof nearest the associated crease 22 or 28. The notches 53, 55, 57 and 59 are dimensioned to receive adjustable strap members for mounting in the manner explained below.

As shown in FIGS. 1–3, the first sheet of metal 14 is adapted to overlie the second sheet of metal 16 such that the creases 22 and 28 are aligned and adjacent to one another. Planar members 18 and 20 on the first sheet of metal 14 overlap planar members 24 and 26 on the second sheet of metal 16 respectively. As noted above, slots 30 through 37 are parallel to and spaced distance "a" away from the associated creases 22 and 28. As a result, when the first and second sheets of metal 12 and 14 are placed in overlapping relationship as shown in FIGS. 1 and 2, at least one slot on planar member 18 will be at least partly in register with a slot on planar member 24. Similarly, at least one slot on planar member 20 will be at least partly in register with a slot on planar member 26. More particularly, and as shown in FIG. 2, slots 30 and 34 are partly in register, and slots 32 and 36 are partly in register. The degree to which the slots are in register will vary, of course, according to the particular longitudinal dimensions of the exhaust system part to which shield 10 is attached. Additionally, in certain instances slots 30 and 35, slots 31 and 34, slots 32 and 37, and slots 33 and 36 will define pairs of slots at least partly in register. This will occur generally only on very small exhaust system parts which require protection from heat shield 12.

Figure 4:
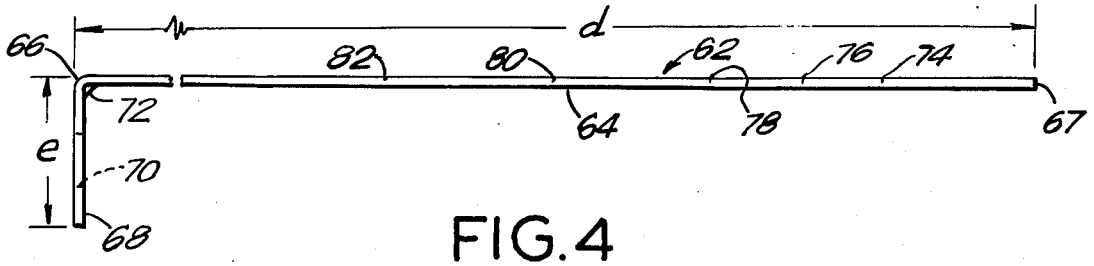
FIG. 4 is a side elevational view of a mounting member of the subject invention.
Figure 5:
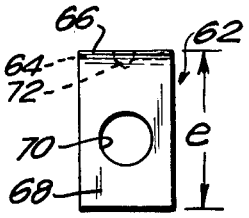
FIG. 5 is a top plan view of the mounting member shown in FIG. 4.
Figure 6:
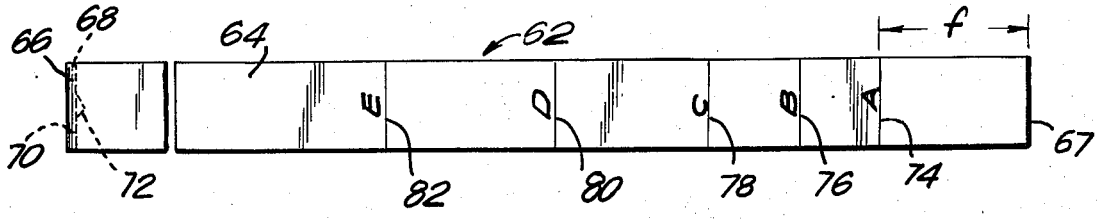
FIG. 6 is an end view of the mounting member shown in FIGS. 4 and 5.

Turning to FIGS. 4–6, adjustable mounting members 62 are provided for mounting the heat shield 12 on the muffler 10 or other exhaust system component. The mounting member 62 includes an elongated strap portion 64 having opposed ends 66 and 67. The length of strap portion 64 as indicated by dimension "d" is approximately 12.25 inches. Fastening portion 68 is connected to and extends perpendicularly from strap portion 64 adjacent end 66 thereof. As illustrated in FIGS. 4 and 5, fastening portion 68 extends distance "e" which preferably equals approximately 1.00 inches. Additionally, as shown in FIG. 5, fastening portion 68 is provided with hole 70 through which a bolt may be inserted for mounting purposes.

Stiffening rib 72 is provided adjacent end 66 of strap portion 64 extending diagonally between the strap and fastening portions 64 and 68 respectively. Stiffening rib 72 ensures that the strap and fastening portions 64 and 68 remain in perpendicular alignment with respect to one another even when forces are exerted on the respective members during mounting.

The strap portion 64 is provided with stamped bend lines 74, 76, 78, 80 and 82. The stamp bend lines enable the strap portion 64 to be bent through approximately 180° to form a generally U-shaped end portion for grasping the tabs of the heat shield for mounting purposes as explained below. As illustrated in FIG. 6, stamped bend line 74 is spaced from end 67 of strap portion 64 by distance "f" which preferably equal 1.00 inches. This 1.00 inch length of distance "f" ensures that for the largest mufflers used with the subject heat shield 12, the strap portion 64 can securely grasp the tabs 38, 40, 44 or 46 of the heat shield 12. Additionally, as shown in FIG. 6 alpha numeric characters are disposed adjacent the stamped bend lines 74–82. The alpha numeric characters enable the subject mounting members to be used in conjunction with a chart provided by the manufacturer to indicate the proper adjustment to be made to the mounting member 62 for each of various size exhaust assembly parts.

Returning to FIG. 1, the subject universal heat shield typically would be packaged and marketed as a kit including first and second sheets of metal 14 and 16 along with associated machine screws 58 and 60, lock washers and nuts to be used with machine screws 58 and 60, and two pairs of mounting members 62 with associated bolts washers and nuts. To assemble the subject heat shield, the first and second sheets of metal 14 and 16 are placed loosely in overlapping relationship with the creases 22 and 28 thereof respectively being substantially adjacent to one another. The first and second sheets of metal 14 and 16 are slidably moved with respect to one another to approximate the length of the exhaust system part with which the heat shield 12 will be used. The machine screws 58 and 60 are then placed through slots 30 and 32 on the first sheet of metal 14 and extend through the slots 34 and 36 respectively on the second sheet of metal. Machine screws 58 and 60 then are loosely fastened in this position. With the heat shield 12 loosely assembled in this manner, the first and second sheets of metal 14 and 16 are slidably moved with respect to one another so that the heat shield 12 approximates the overall length of the muffler 10 or other exhaust part with which the heat shield 12 is used. Each mounting member 62 then is bent at the appropriate stamped bend line 74 through 82 to facilitate mounting of the heat shield 12 on the particular size muffler 10. The bent mounting members 62 then are positioned to engage the notches on the respective tabs, as illustrated most clearly in FIGS. 1 and 2. The strap portion 64 of each mounting member 62 then is bent manually around the perimeter of the muffler 10 so that the respective fastening portions 68 thereof are in proximity to one another and substantially parallel. A bolt then is inserted through the hole 70 in one fastening portion 68 and subsequently through the corresponding hole in the other fastening portion 68. A nut is then mounted on this bolt and tightened sufficiently to securely mount the subject heat shield 12 on the muffler 10. After the heat shield is mounted securely in this manner, the machine screws 58 and 60 are tightened to complete the mounting operation. If the particular muffler 10 has a cross sectional configuration which is incompatible with the angle $\alpha$ between the planar members of the respective first and second sheets of metal 14 and 16, the angular alignment between the planar members can be adjusted easily by the installer of the universal heat shield 12.

In summary, a universal heat shield is provided which includes at least first and second sheets of metal configured to be disposed in overlapping slidably relationship to one another. Each sheet of metal includes at least two planar members which intersect in a crease line. Each planar member is provided with one or more slots which are disposed equidistant from the respective crease lines. Machine screws and bolts extend through the respective slots to hold the sheets of metal in their desired longitudinal relationship with respect to one another. Adjustable straps are provided to mount the heat shield on the exhaust system part. The angular relationship between the planar members of the respective sheets of metal can be adjusted to accommodate exhaust system parts of varying contours.

What is claimed is:

1. An adjustable heat shield for an exhaust system part, said shield being adjustable for attachment to exhaust system parts of different lengths and contours, said shield comprising:

a plurality of elongated sheets of metal each of which includes a plurality of angularly aligned planar members, with each pair of adjacent planar members intersecting along a crease line which extends generally parallel to the longitudinal axis of said sheet, the angular alignment of said planar members about the respective crease lines being adjustable, at least one of said planar members of each said sheet including one or more slots aligned parallel to said crease line, with the slots in each sheet being spaced equidistant from the respective crease line such that when said sheets are placed in face to face overlapping relationship, the slots of one said sheet will be at least partly in register with the slots of adjacent sheets;

fastening means for extending through said slots to adjustably secure said sheets in overlapping face to face relationship;

means for supporting said sheet in spaced relationship with respect to said exhaust system part; and means for removably mounting said shield on said exhaust system part, whereby said sheets may be slidably moved with respect to one another parallel to said crease lines to adjust the length of said shield, and whereby the angular alignment between the planar members of each said sheet can be adjusted to change the contour of said shield.

2. An adjustable heat shield as in claim 1 wherein each said sheet includes two planar members.

3. An adjustable heat shield as in claim 2 wherein each said planar member is generally rectangular.

4. An adjustable heat shield as in claim 2 comprising two elongated sheets of metal.

5. An adjustable heat shield as in claim 1 wherein said means for supporting said shield comprises a plurality of extensions extending from each said sheet of metal, and a tab connected to and extending from each said extension, said tab being generally parallel to the planar member to which its respective extension is connected.

6. An adjustable heat shield as in claim 5 wherein each said sheet of metal includes a pair of extensions and tabs, and wherein each said tab includes a notch on the portion thereof nearest to other tab in said pair.

7. An adjustable heat shield as in claim 5 wherein said means for mounting said shield comprises a plurality of straps, said straps being adapted to engage said tabs and said exhaust system part, thereby mounting said shield on said exhaust system part.

8. An adjustable heat shield as in claim 6 wherein said means for mounting comprises two pairs of adjustable mounting members, each said adjustable mounting member comprising an elongated strap portion and a fastening portion extending perpendicularly from one end of said strap portion, the end of said strap portion opposite said fastening portion including a plurality of spaced apart stamped bend lines extending generally perpendicular to the longitudinal axis of said strap portion and enabling said strap portion to be bent into a generally U-shaped configuration, said strap portion being dimensioned such that said U-shaped configuration can engage the notch in each said tab, whereby the strap portion of each said adjustable mounting member may be bent into said generally U-shaped configuration at a selected stamped bend line thereby enabling each said strap portion to engage the notch in one said tab, and whereby the remainder of said strap portion may be bent around the exhaust system part enabling the fastening portions in each said pair of mounting members to be affixed to one another thereby mounting said heat shield on said exhaust system part.

* * * * *